US008080751B2

(12) United States Patent
Onuki et al.

(10) Patent No.: US 8,080,751 B2
(45) Date of Patent: Dec. 20, 2011

(54) PUSH BUTTON SWITCH WITH A DISPLAY DEVICE

(75) Inventors: Kazumitsu Onuki, Kawasaki (JP); Hiroki Ura, Kawasaki (JP)

(73) Assignee: Nihon Kaiheiki Industrial Company, Ltd., Kanagawa (JP)

( * ) Notice: Subject to any disclaimer, the term of this patent is extended or adjusted under 35 U.S.C. 154(b) by 646 days.

(21) Appl. No.: 12/232,765

(22) Filed: Sep. 24, 2008

(65) Prior Publication Data

US 2009/0107817 A1 Apr. 30, 2009

(30) Foreign Application Priority Data

Oct. 24, 2007 (JP) ..... 2007-276534

(51) Int. Cl.
*H01H 9/00* (2006.01)

(52) U.S. Cl. ..... 200/314

(58) Field of Classification Search ..... 200/314, 200/293, 5 A
See application file for complete search history.

(56) References Cited

U.S. PATENT DOCUMENTS

| | | | | |
|---|---|---|---|---|
| 4,987,279 | A * | 1/1991 | Hirose et al. | 200/314 |
| 5,072,085 | A * | 12/1991 | Shinohara et al. | 200/314 |
| 5,278,362 | A * | 1/1994 | Ohashi | 200/5 A |
| 7,554,047 | B2 * | 6/2009 | Verdu et al. | 200/314 |
| 7,745,742 | B2 * | 6/2010 | Li et al. | 200/5 R |
| 7,943,875 | B2 * | 5/2011 | Chu | 200/293 |

FOREIGN PATENT DOCUMENTS

JP 2005-093254 4/2005

* cited by examiner

*Primary Examiner* — Vanessa Girardi
(74) *Attorney, Agent, or Firm* — Bacon & Thomas, PLLC

(57) ABSTRACT

A push button switch is provided, which has a long life, high stability in operation, an operation force and an operation feeling which do not change from the initial state, and a display device which has a wide viewing angle and is capable of realizing low power consumption.

5 Claims, 6 Drawing Sheets

PUSH BUTTON SWITCH WITH A DISPLAY DEVICE

BACKGROUND OF THE INVENTION

1. Field of the Invention

The present invention relates to a push button switch, and more particularly, to a structure of a push button switch with a display device which is suitable for use in an apparatus operated with high frequency, has a long life, and is capable of stable and smooth operation.

2. Description of the Related Art

In the conventional push button switch, resins with high durability such as polyacetal resin or fiber reinforced plastic are generally used in sliding parts between an operational button and a switching body. In addition, in an apparatus which is used with high operation frequency and requires a smooth operation feeling, a lubricating agent such as grease is applied to the sliding part.

Even if a plunger and a case formed of a resin with a small friction coefficient are used, when used as a push button switch in an apparatus with high operation frequency, problems happens in durability such as wear-out of the resin surface due to mutual friction of resin, an increase in looseness of the operational button, and degradation in the operation feeling due to the looseness of the operational button. Especially, constantly stable operation force and operation feeling are required for the push button switch used in the field of a broadcasting apparatus. Furthermore, a market requires a push button switch having fairly good operability so as not to give any fatigue to fingers during the operation.

In addition, the present applicant has developed a push button switch which generates smooth operation feeling by disposing round pins between a case and a plunger, and by moving the plunger against the case along the round pins as rails (See Patent Document 1 below).

On the other hand, as for a display device, an STN liquid crystal is used, which has problems such as complicated configuration and increased consumption of electric power due to a need for a backlight. In addition, there exists another problem that the viewing angle is narrow.

[Patent Document 1] Japanese Patent Application Publication No. 2005-93254

In the conventional push button switch with round pins as rails, engaging grooves are provided longitudinally on the inner wall of the case and on the outer wall of the plunger, respectively, and the round pins are freely fit to the engaging grooves.

Due to the use of a liquid crystal as a display device, there is a problem such as complicated configuration due to a need for a backlight. In addition, there exist other problems relating to the liquid crystal such that the viewing angle is narrow and that consumption of an electric power is not negligible.

In light of the foregoing, it is an object of the present invention to provide a push button switch with a display device which has a long life, high stability in operation to keep the initial operation force and operation feeling unchanged, and a wide viewing angle, and which is capable of reducing the electric power consumption and simplifying the configuration.

SUMMARY OF THE INVENTION

In order to achieve the object described above, the present invention provides the following:

[1] A push button switch with a display device comprising a switching body including a case having an opening part on the upper side thereof and a case cover covering the case, a contact mechanism provided within the switching body, and a plunger protruding upward from a hole of the case cover, wherein up and down movement of the plunger is guided within the switching body to connect with the contact mechanism so as to open and close an electric circuit, the push button switch with a display device further comprising longitudinal grooves provided at four corners of the outer side surfaces of the case, metallic round pins having a small friction coefficient fastened to the grooves, an operational button covering the switching body and being arranged in convex-concave fitting with the plunger, a holder fixed within the operational button by a supporting plate, and an organic light emitting display device attached to the holder.

[2] The push button switch with a display device in accordance with above [1], wherein connecting wires of the organic light emitting display device are connected to connecting terminals of the case through a flexible printed circuit board which has a control IC.

[3] The push button switch with a display device in accordance with above [2], wherein the control IC is implemented as a COG (chip on glass) on a rear surface of the organic light emitting display device.

[4] The push button switch with a display device in accordance with above [1], wherein an elastic adhesive double faced tape is provided between the organic light emitting display device and the flexible printed circuit board on the holder to suppress looseness of the organic light emitting display device.

[5] The push button switch with a display device in accordance with above [1], wherein an elastic sheet is provided between the holder and the supporting plate to suppress looseness of the organic light emitting display device.

DESCRIPTION OF THE PREFERRED EMBODIMENTS

The present invention provides a push button switch with a display device comprising a switching body including a case having an opening part on the upper side thereof and a case cover covering the case, a contact mechanism provided within the switching body, and a plunger protruding upward from a hole of the case cover, wherein up and down movement of the plunger is guided within the switching body to connect with the contact mechanism so as to open and close an electric circuit, the push button switch with a display device further comprising longitudinal grooves provided at four corners of the outer side surfaces of the case, metallic round pins having a small friction coefficient fastened to the grooves, an operational button covering the switching body and being arranged in convex-concave fitting with the plunger, and a holder fixed within the operational button by a supporting plate, and an organic light emitting display device attached to the holder. Thus, no unreasonable force in other directions than the up and down movement of the operational button is added to the push button switch with a display device, and the looseness of the operational button can be suppressed. Furthermore, a display device can be provided which is simple in configuration, has a wide viewing angle, and are capable of reducing an electric power consumption.

Embodiments of the present invention will be described in detail in the following.

Figure 1:
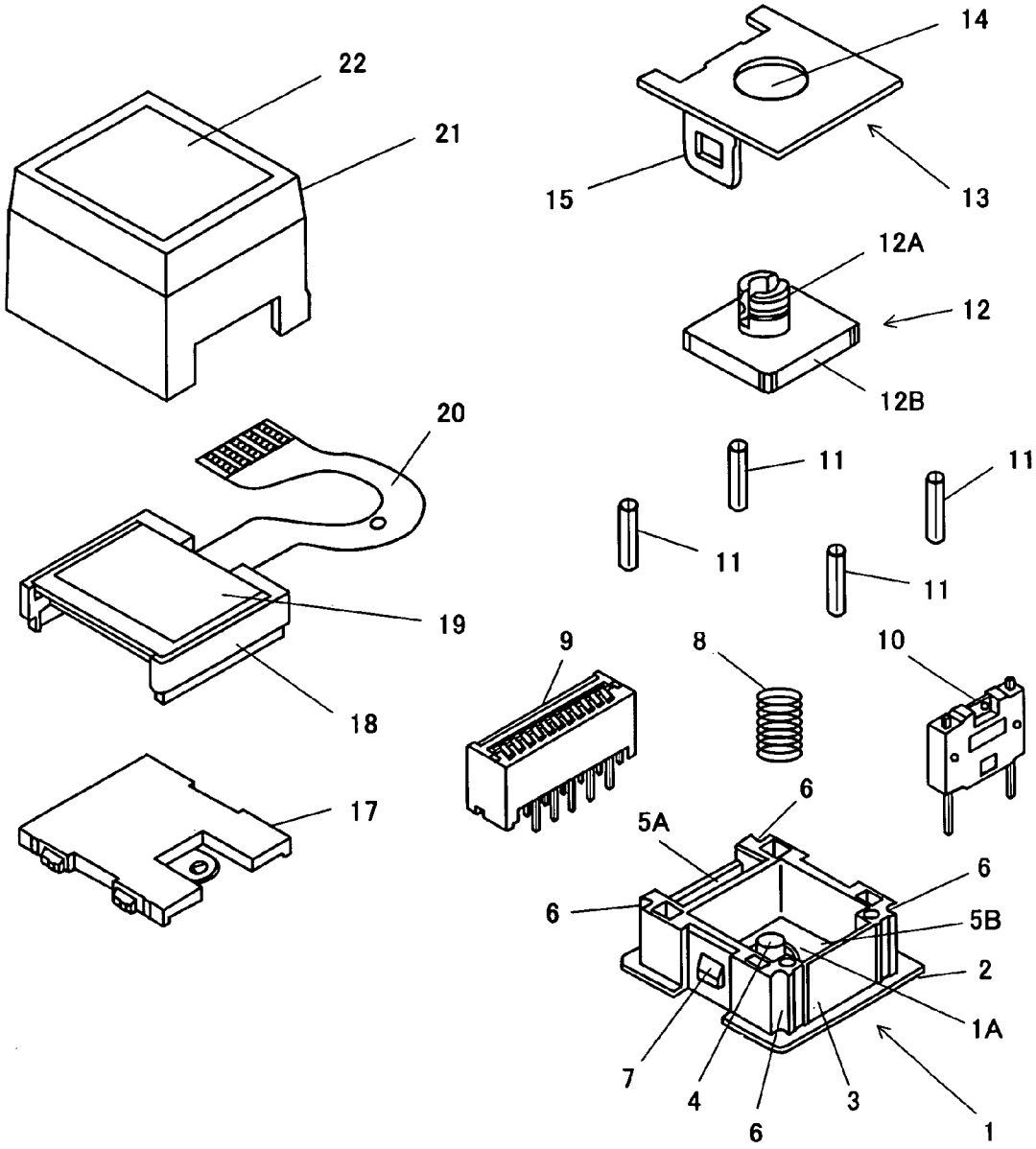
FIG. 1 shows an exploded perspective view of a push button switch with a display device in accordance with an embodiment of the present invention.
Figure 2:
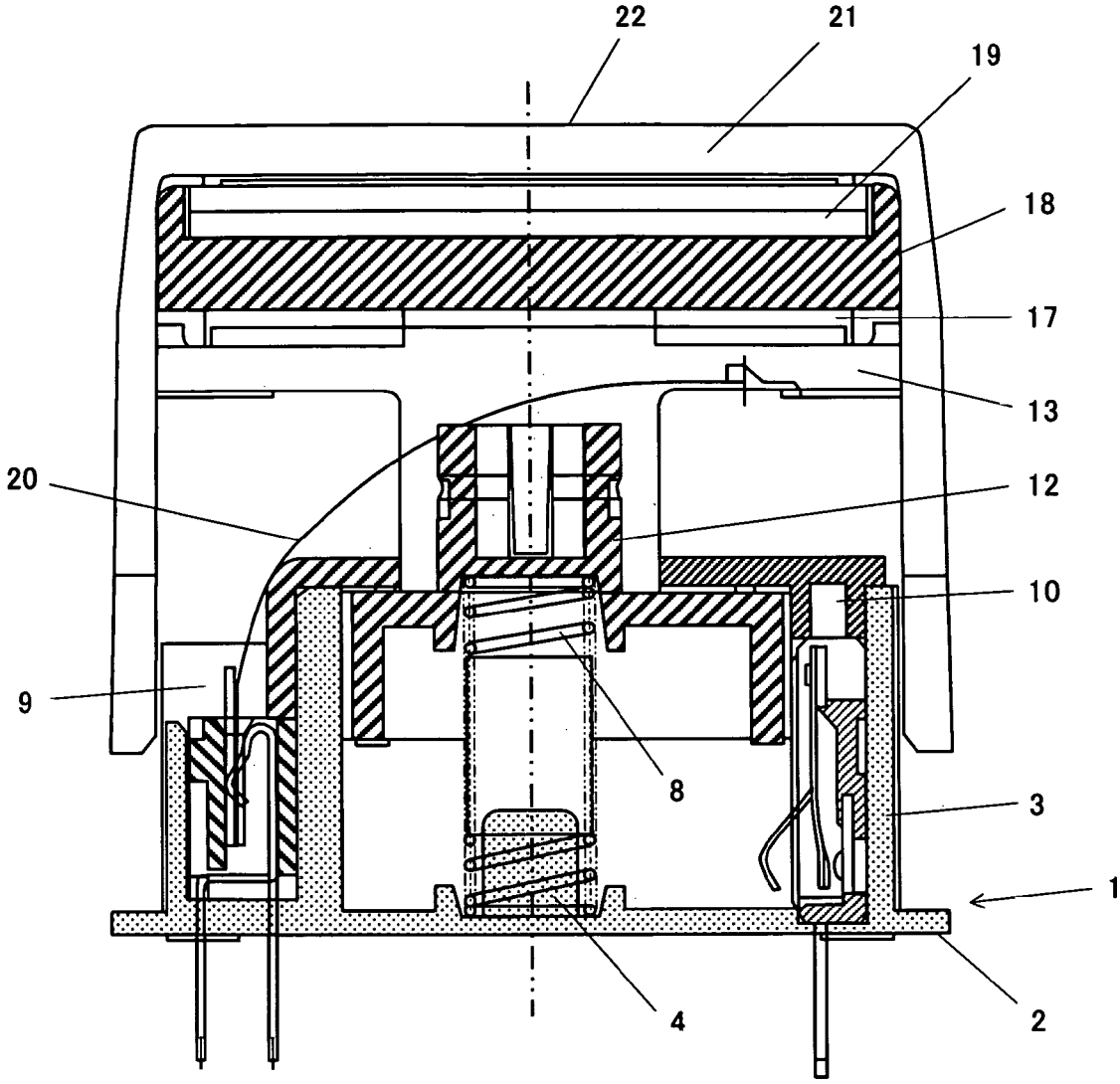
FIG. 2 shows a cross-sectional view of a push button switch with a display device in accordance with the embodiment of the present invention.
Figure 3:
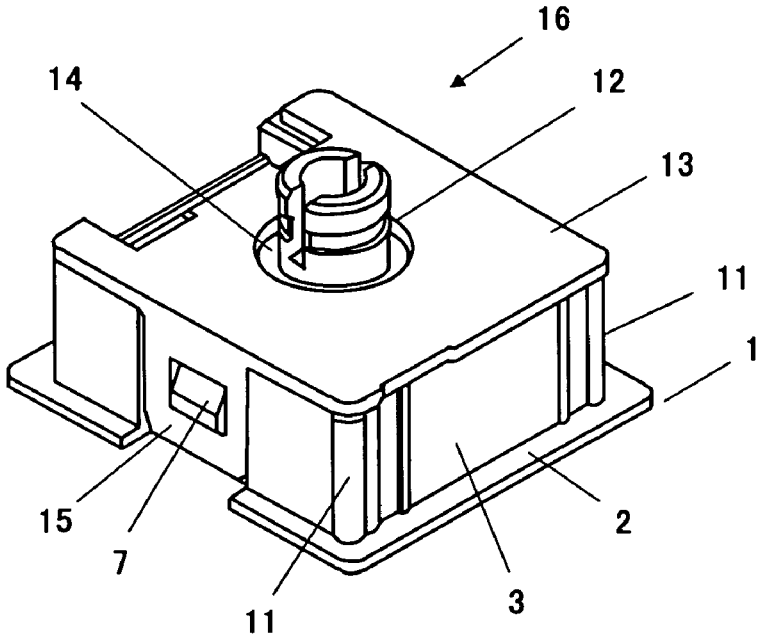
FIG. 3 is a perspective view of a switching body of a push button switch with a display device in accordance with the embodiment of the present invention.
Figure 4:
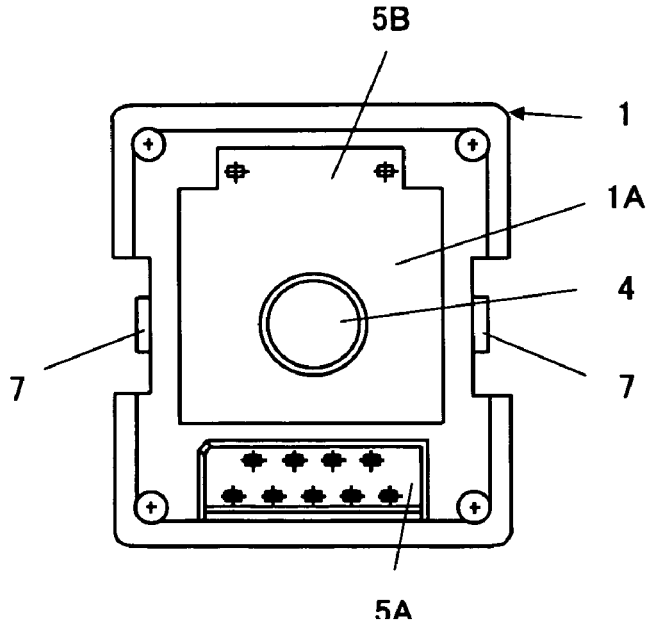
FIG. 4 is a plan view of an inner part of a switching body with a case cover shown in FIG. 3 removed.
Figure 5:
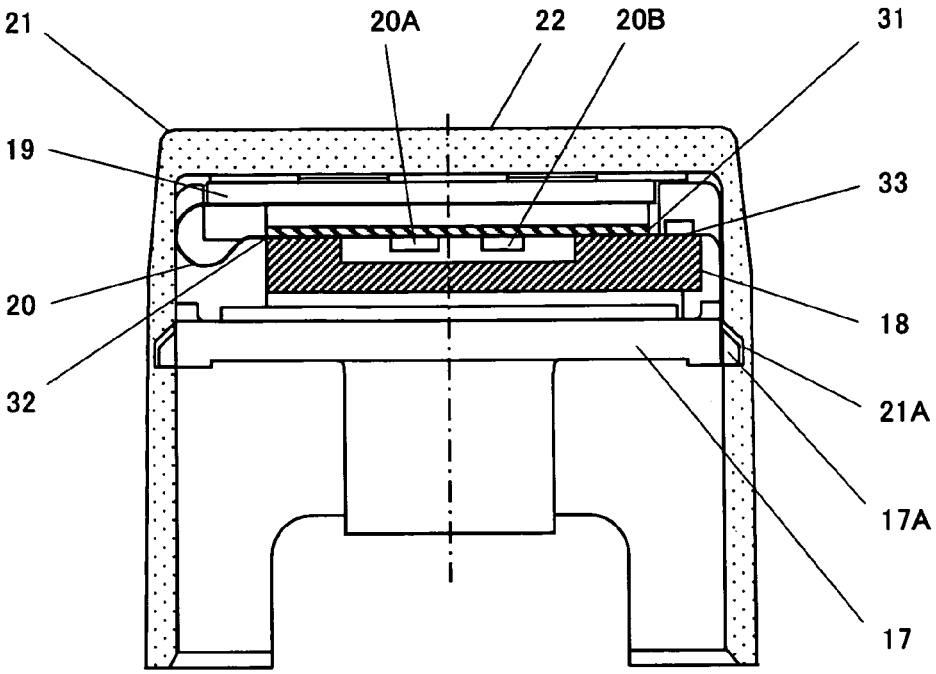
FIG. 5 is a cross-sectional view of an organic light emitting display device attached to an operational button of a push button switch with a display device in accordance with the embodiment of the present invention.

FIG. 1 shows an exploded perspective view of a push button switch with a display device in accordance with an embodiment of the present invention. FIG. 2 shows a cross-sectional view of a push button switch with a display device in accordance with the embodiment of the present invention. FIG. 3 is a perspective view of a switching body of a push button switch with a display device in accordance with the embodiment of the present invention. FIG. 4 is a plan view of an inner part of a switching body with a case cover shown in FIG. 3 removed. FIG. 5 is a cross-sectional view of an organic light emitting display device attached to an operational button of a push button switch with a display device in accordance with the embodiment of the present invention.

In these figures, reference numeral 1 is a case, 1A is an opening part of the case 1, 2 is a brim protruding outward from a bottom surface of the case 1, 3 is an outer side surface of the case 1, 4 is a cylindrical protrusion protruding to the center of the case 1 to guide a coil spring 8, 5A is an accommodation part for a connector, 5B is an accommodation part for a switching element, 6 is longitudinal grooves formed at four corners of the outer side surfaces 3 of the case 1, 7 is fixing parts formed on two opposing side surfaces of the outer side surfaces 3 of the case 1, 9 is a connector, 10 is a switching element, 11 is metallic round pins having a small friction coefficient and being fastened to the longitudinal grooves 6, 12 is a plunger disposed on the coil spring 8, 12A is a cylindrical part of the plunger 12, 12B is an angular part of the plunger 12, 13 is a case cover comprising a round hole 14 through which the plunger 12 is attached and a hanging part 15 having a square hole into which the fixing part 7 fits, and 16 is a switching body comprising the case 1, the plunger 12 and the case cover 13 described above.

Reference numeral 17 is a supporting plate, 18 is a holder, 19 is an organic light emitting display device attached to the holder 18. The organic light emitting display device 19 comprises an organic light emitting diode panel. The holder 18 having the organic light emitting display device (organic light emitting diode panel) 19 is fixed in a held state by the supporting plate 17 attached to the holder 18 from the bottom surface thereof. More particularly, an outwardly protruding part 17A of the supporting plate 17 is guided from the bottom of the operational button 21 and engaged to stop at an engagement hole 21A formed inside the operational button 21. 20 is a flexible printed circuit board connected to the organic light emitting display device (organic light emitting diode panel) 19, and a control IC (not shown in the figures) is implemented in the middle thereof. The front end of the flexible printed circuit board 20 is drawn around and connected to the connector 9 in the case 1. 20A and 20B are an electronic component and a control IC implemented on the flexible printed circuit board 20. 21 is an operational button formed of Optically transparent material and covering the organic light emitting display device 19. Display of the organic light emitting display device 19 is performed in a display window 22 on the top surface of the operational button 21. 31 is an elastic adhesive double faced tape attached between the organic light emitting display device 19 and the flexible printed circuit board 20, 32 and 33 are a double faced tape to suppress the looseness of the organic light emitting display device 19, attached between the organic light emitting display device 19 and the holder 18 for suppressing the looseness of the organic light emitting display device 19.

It is very difficult to secure the organic light emitting display device 19 without looseness only by the design of dimensions of respective component, when fixing the organic light emitting display device 19 attached to the holder 18. Furthermore, for the push button switch which may be operated more than several hundred thousand times, the organic light emitting display device 19 may move a little within the operational button 21 during the operation due to the looseness, which might give a significant influence on the quality of the organic light emitting display device 19.

Therefore, by attaching the organic light emitting display device 19 to the flexible printed circuit board 20 by using an elastic adhesive double faced tape 31, the organic light emitting display device 19 is sandwiched between the operational button 21 and the supporting plate 17 in a state undergoing an elastic force from the elastic adhesive double faced tape 31. Thus the organic light emitting display device 19 may be fastened between the operational button 21 and the supporting plate 17 without looseness, or even with making a compensation of the looseness, without precisely setting the respective dimension of the components.

The organic light emitting display device (organic light emitting diode panel) 19 is a display device which emits light by itself, and therefore does not require any backlight, and hence is capable of reducing an electric power consumption and simplifying the structure thereof as compared with the conventional liquid crystal display device and plasma display device. In addition, the organic light emitting display device (organic light emitting diode panel) 19 can be realized to have a wide viewing angle enough to secure a visibility from a position laterally apart from the switch.

The switching body 16 is configured by convex-concave fitting of the case 1 and the case cover 13 with the plunger 12 attached thereto. Within the switching body 16, an accommodation part of a connector 5A is formed, and a connector 9 is stored within the accommodation part 5A. To this connector 9, an end part of the flexible printed circuit board 20 described in the following is inserted. Furthermore, a switching element 10 constituting the contact mechanism is disposed in an accommodation part 5B on the inner side surface opposite to the accommodation part for the connector 9 of the switching body 16.

Within the switching body 16, a plunger 12 comprising a cylindrical part 12A and an angular part 12B is disposed, and the cylindrical part 12A of the plunger 12 protrudes from a round hole 14 formed almost at the center of the case cover 13 included in the switching body 16. A cylindrical protrusion 4 provided at the center of the bottom surface of the case 1 included in the switching body 16 guides a coil spring 8 provided at the lower surface of the plunger 12, and by up and down movement of the plunger 12, switching element 10 is turned on and off, thereby open and close an electric circuit.

In addition, at four corners on the outer side surfaces 3 of the case 1 included in the switching body 16, longitudinal grooves 6 are provided, and metallic round pins 11 having a small friction coefficient are provided to the longitudinal grooves 6 between the case 1 and the case cover 13. Here, the diameter of the longitudinal groove 6 provided on the case 1 included in the switching body 16 is formed to be slightly smaller than the diameter of the round pin 11. Hence, the round pin 11 is fastened rigidly by press fitting to the longitudinal groove 6. Thus, the up and down movement of the operational button 21 described below becomes stable and smooth, and a push button switch is realized which has a long life and is highly stable in operation force and operation feeling.

The switching element 10 constituting the contact mechanism is provided in the switching body 16, and a working axis (not shown in the figures) to drive this switching element 10 is protruded.

By the configuration described above, an electric power is supplied to the organic light emitting display device (organic light emitting diode panel) 19 from the terminal of the connector 9 through an IC chip (not shown in the figures) on the flexible printed circuit board 20. Drive and control of the organic light emitting display device (organic light emitting diode panel) 19 is performed by the IC chip (not shown in the figures), thereby enabling to display various characters and figures and to change various tones of color.

FIG. 3 shows how the round pins 11 are provided to the longitudinal grooves 6 at the four corners on the outer side surfaces 3 of the case 1 of the switching body 16, and the round pins 11 are disposed to be protruded outwardly from the outer side surfaces 3. When the operational button 21 is attached, the up and down movement of the operational button 21 becomes stable and smooth by these round pins 11, thereby realizing stable and long lived operation force and operation feeling.

Figure 6:
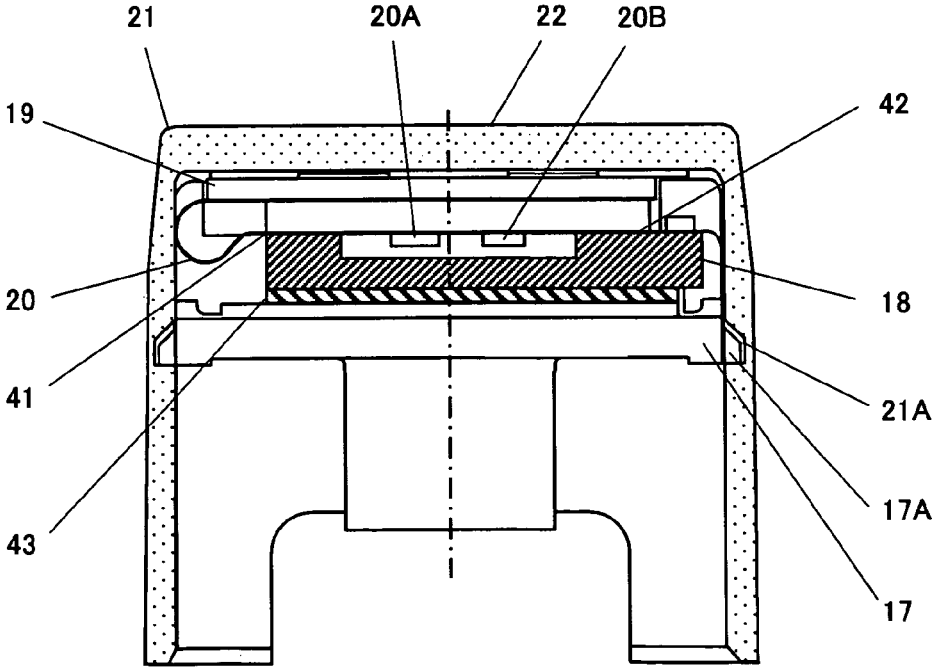
FIG. 6 is a cross-sectional view of an organic light emitting display device attached to an operational button of a push button switch with a display device in accordance with another embodiment of the present invention.

FIG. 6 is a cross-sectional view of an organic light emitting display device attached to an operational button of a push button switch with a display device in accordance with another embodiment of the present invention.

In this embodiment, in order to suppress the looseness of the organic light emitting display device 19, a double faced tapes 41, 42 are attached between the organic light emitting display device 19 and the holder 18, and an elastic sheet 43 such as a rubber is attached between the holder 18 and the supporting plate 17.

In this way, a similar effect can be realized by providing an elastic sheet 43 such as a rubber between the holder 18 and the supporting plate 17 in place of the elastic adhesive double faced tape 31 shown in FIG. 5.

Figure 7:
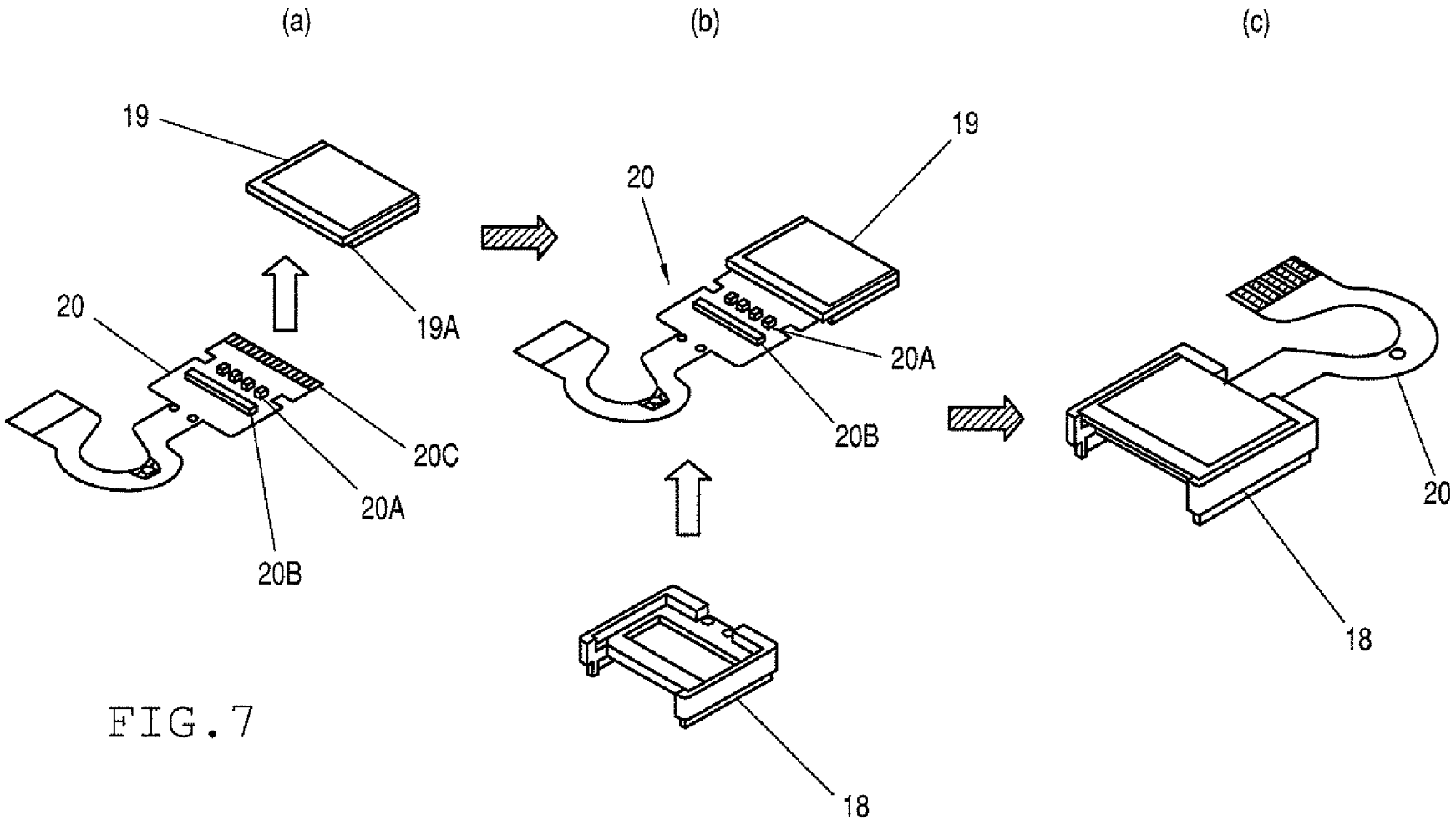
FIG. 7 is a perspective view of assembling method of an organic light emitting display device attached to an operational button of a push button switch with a display device in accordance with the embodiment of the present invention.

FIG. 7 is a perspective view of assembling method of an organic light emitting display device attached to an operational button of a push button switch with a display device in accordance with the embodiment of the present invention.

First, as shown in FIG. 7(*a*), the front edge part 20C of the flexible printed circuit board 20 is pressed from the lower side to the terminal part 19A of the organic light emitting display device 19. Then, the flexible printed circuit board 20 is connected to the terminal part 19A of the organic light emitting display device 19 by using an anisotropic conductive film (not shown in the figures) as shown in FIG. 7(*b*). Then, as shown in FIG. 7(*c*), the organic light emitting display device 19 connected to the flexible printed circuit board 20 is attached to the holder 18.

Thus, since the control IC 20B is implemented on the flexible printed circuit board 20 which can be folded, and located under the organic light emitting display device 19, a compact arrangement can be configured.

Figure 8:
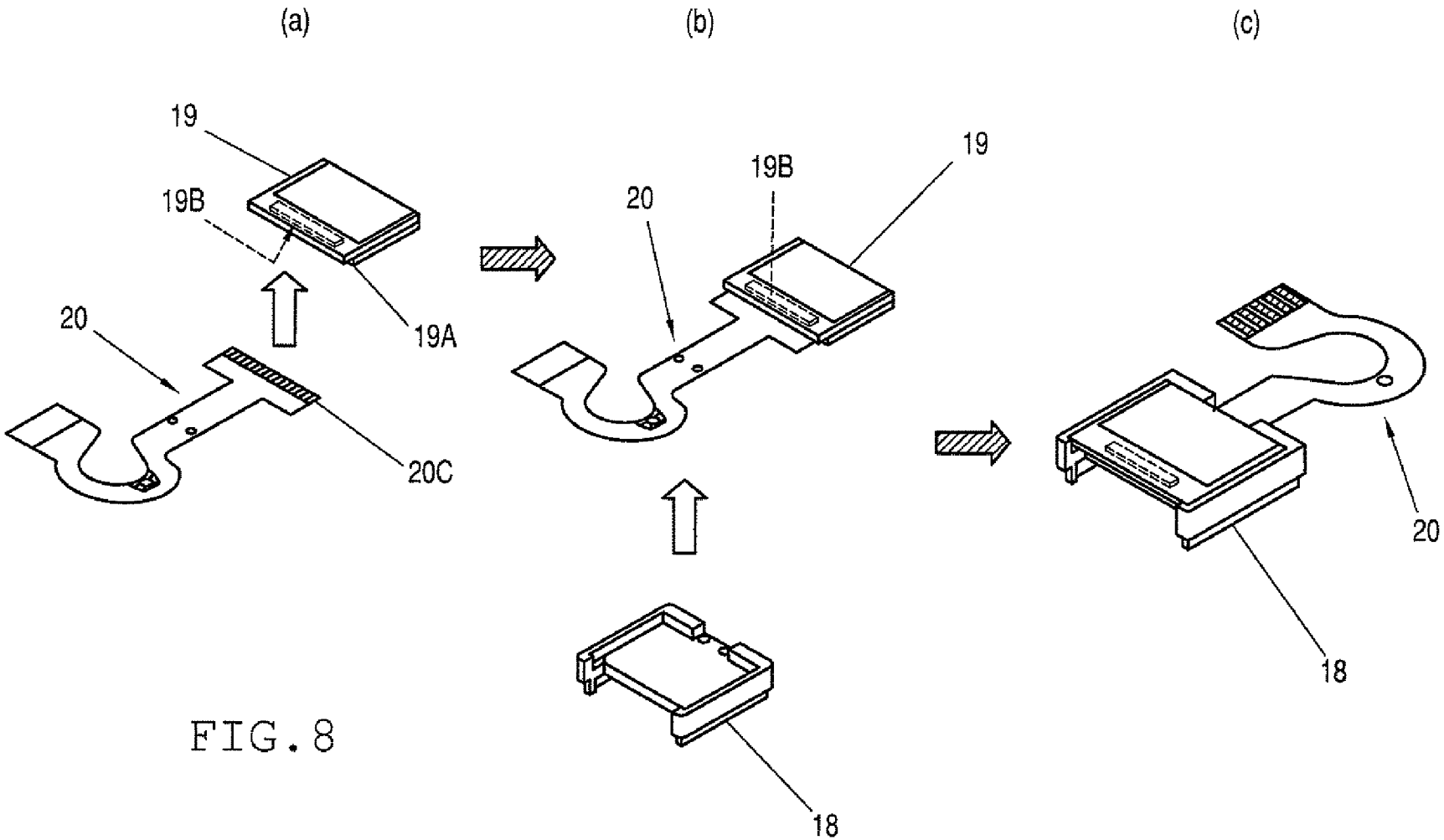
FIG. 8 is a perspective view of assembling method of an organic light emitting display device attached to an operational button of a push button switch with a display device in accordance with another embodiment of the present invention.

FIG. 8 is a perspective view of assembling method of an organic light emitting display device attached to an operational button of a push button switch with a display device in accordance with another embodiment of the present invention.

In this embodiment, the control IC 19B is implemented not on the flexible printed circuit board 20 as shown in FIG. 7, but on the rear surface of the organic light emitting display device 19 by using the COG (chip on glass) technique. In other words, the flexible printed circuit board 20 is used only for connecting the organic light emitting display device 19 and the connector 9, and the control IC 19B is not implemented on the flexible printed circuit board 20.

The present invention is not limited to the embodiment described above, and various modification is possible based on the spirit of the present invention, and these modifications are not intended to be excluded from the scope of the present invention.

As described above, the push button switch with a display device in accordance with the present invention not only guides the up and down motion of the plunger within the switching body. From the structure of the operational button covering the switching body within which the longitudinal grooves are provided at four corners on the outer side surfaces of the case and the metallic round pins having a small friction coefficient are fixed to the longitudinal grooves, the switching body guides the up and down motion of the operational button, and the round pins and the inner side surfaces of the operational button contact linearly. Therefore no unreasonable force in other directions is added to the up and down motion of the operational button, resulting in a push button switch whose operation force and operation feeling is highly stable.

In addition, since concave parts (not shown in the figures) to engage with the round pins are provided on the inner side surfaces of the operational button, the concave parts guide the up and down movement of the operational button, thereby providing a push button switch with a display device which has a highly stable operability with no looseness in operation of the operational button.

Furthermore, the present invention can provide a push button switch with a display device in which a display device having a wide viewing angle and capable of reducing an electric power consumption can be disposed with no looseness.

Furthermore, the present invention can provide a push button switch with a display device in which the structure can be simplified because of no backlight required, and operation stroke can easily be adjusted without changing the height dimension from the switch using a backlight.

Furthermore, the present invention can provide a push button switch with a display device in which a compact configuration can be realized because the control IC is implemented on the flexible printed circuit board, and/or disposed on the rear surface of the organic light emitting display device.

What is claimed is:

1. A push button switch with a display device comprising a switching body comprising a case having an opening part on the upper side thereof and a case cover covering the case, a contact mechanism provided within the switching body, and a plunger protruding upward from a hole of the case cover wherein up and down movement of the plunger is guided within the switching body to connect with the contact mechanism so as to open and close an electric circuit;

wherein the push button switch with a display device further comprising:

longitudinal grooves provided at four corners of the outer side surfaces of the case;

metallic round pins having a small friction coefficient fastened to the grooves;

an operational button covering the switching body and being arranged in convex-concave fitting with the plunger;

a holder fixed within the operational button by a supporting plate; and an organic light emitting display device attached to the holder.

2. The push button switch with a display device in accordance with claim 1, wherein connecting wires of the organic light emitting display device are connected to connecting terminals of said case through a flexible printed circuit board which comprises a control IC.

3. The push button switch with a display device in accordance with claim 2, wherein the control IC is implemented as a COG (chip on glass) on a rear surface of the organic light emitting display device.

4. The push button switch with a display device in accordance with claim 1, wherein an elastic adhesive double faced tape is provided between the organic light emitting display device and the flexible printed circuit board on the holder to suppress looseness of the organic light emitting display device.

5. The push button switch with a display device in accordance with claim 1, wherein an elastic sheet is provided between the holder and the supporting plate to suppress looseness of the organic light emitting display device.

* * * * *